US008764417B2

(12) United States Patent
Kim et al.

(10) Patent No.: US 8,764,417 B2
(45) Date of Patent: Jul. 1, 2014

(54) ELECTRIC PUMP FOR VEHICLE

(75) Inventors: Chi Myung Kim, Gyunggi-do (KR); Haenjin Ko, Seoul (KR); Seung Yong Lee, Gyeonggi-do (KR); Harkkoo Kim, Gyeonggi-do (KR); Yun Seok Kim, Gyeonggi-do (KR); Yong Sun Park, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 169 days.

(21) Appl. No.: 13/216,650

(22) Filed: Aug. 24, 2011

(65) Prior Publication Data

US 2012/0121448 A1 May 17, 2012

(30) Foreign Application Priority Data

Nov. 15, 2010 (KR) ..... 10-2010-0113422

(51) Int. Cl.
*F04D 29/12* (2006.01)

(52) U.S. Cl.
USPC ..... 417/423.11

(58) Field of Classification Search
USPC ..... 417/423.11, 423.7, 423.15
See application file for complete search history.

(56) References Cited

U.S. PATENT DOCUMENTS

2010/0090551 A1* 4/2010 Burton ..... 310/88

FOREIGN PATENT DOCUMENTS

| | | |
|---|---|---|
| KR | 10-2006-0092342 | 8/2006 |
| KR | 10-2007-0099957 | 10/2007 |
| KR | 10-2010-0072911 | 7/2010 |

* cited by examiner

*Primary Examiner* — Bryan Lettman
(74) *Attorney, Agent, or Firm* — Edwards Wildman Palmer LLP; Peter F. Corless

(57) ABSTRACT

An electric pump for a vehicle includes a pump body that is divided into a motor room and a pump room, a shaft that is connected to the motor room and the pump room and a sealing unit is interposed therebetween, and an impeller that is mounted on the shaft in the pump room. More specifically, a leachate exhaust passage for exhausting leachate that is leaked through the sealing unit is formed in the pump body, and the leachate exhaust passage is connected to a reaction gas exhaust portion of a fuel cell stack to aide in the exhaust of the leachate accordingly.

9 Claims, 2 Drawing Sheets

ELECTRIC PUMP FOR VEHICLE

CROSS-REFERENCE TO RELATED APPLICATION

This application claims priority to and the benefit of Korean Patent Application No. 10-2010-0113422 filed in the Korean Intellectual Property Office on Nov. 15, 2010, the entire contents of which are incorporated herein by reference.

BACKGROUND OF THE INVENTION (a) Field of the Invention

The present invention according to an exemplary embodiment relates to an electric pump for a vehicle, and more particularly to an electric pump for a vehicle that exhausts a coolant that is leaked out through a sealing portion, e.g., like a mechanical seal, where the coolant is hereinafter called 'leachate' for convenience.

(b) Description of the Related Art

Generally, a pump circulates coolant through an engine and a heater thereof so as to cool the engine and so as to heat the interior room. The coolant that is pumped from the pump circulates the engine, the heater, or a radiator to exchange the heat and is returned to the pump. The pumps are typically divided into a mechanical type pump and an electric type pump.

Mechanical pumps are connected to a pulley that is fixed on a crankshaft of the engine to be rotated by the crankshaft (i.e. the rotation of the engine). Accordingly, the coolant flux that is pumped from the mechanical pump is determined by the rotation speed of the engine. However, the coolant flux that is necessary in the heater and the radiator is determined independently from the rotation speed of the engine. Thus, the heater and the radiator are abnormally operated in an area that the engine speed is low. That is, the engine speed must be raised to normally operate the heater and the radiator. This causes fuel consumption of the vehicle to rise as a result.

The electric pump is operated by a motor that is controlled by a control apparatus. In this case, the coolant flux can be controlled independent of the engine speed. However, since the components of the electric pump are operated by electricity, it is important that the component of the electric pump has a significant waterproofing. As a result of the ability to control the flux produced by the electrical pump, vehicle manufactures have begun to use them in place of the mechanical pumps. Consequently, various arts have been being developed for improving the performance of the electric pump and the durability thereof.

In general, an electric pump, like the one described above, is divided into a motor room that is composed of a stator and a rotor and a pump room that pumps the coolant. More specifically, a pump body forms the motor room and a volute housing forms the pump room.

Here, the motor room and pump room can be separated by a sealing member, such as a mechanical seal, that is used to prevent the coolant from passing from the pump room to the motor. The sealing member is typically disposed on a shaft that is connected from the motor room to the pump room. Additionally, an impeller is disposed in the pump room to be fixed on the shaft so as to pump the coolant.

Also, a leachate exhaust passage is formed in the pump body of the electric pump so as to exhaust the leachate that is leaked from the motor room through the sealing member of the pump room.

However, the leachate exhaust passages formed in a conventional art exhaust the leachate that is leaked from the pump room to the motor room through the sealing member. Thus, conversely the outside fluid (e.g., water) can flow into the pump room or the motor room through the leachate exhaust passage such that several problems, such as the insulation deterioration of the motor and the bearing corrosion, can arise.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an electric pump for a vehicle having advantages of effectively exhausting leachate to the outside, which leaks through a sealing portion, while at the same time preventing the outside fluid (e.g., water) from flowing into the pump body through a leachate exhaust passage.

An electric pump for a vehicle according to an exemplary embodiment of this invention may include a pump body that is divided into a motor compartment/room and a pump compartment/room, a shaft that is connected to the motor room and the pump room and a sealing unit is interposed therebetween, and an impeller that is mounted on the shaft in the pump room. Furthermore, a leachate exhaust passage is also included which exhausts leachate that is leaked through the sealing unit. The leachate exhaust passage is formed in the pump body and is connected to a reaction gas exhaust portion of a fuel cell stack.

In some embodiments of the present invention, the leachate exhaust passage may be connected to the reaction gas exhaust portion through a connection pipe, which in some instances may also include an orifice pipe.

Furthermore, an exhaust passage through which steam is exhausted may also be formed in the pump body, wherein the steam may be formed through the sealing unit. The steam exhaust passage may intake outside air, in a case that the exhaust pressure of the reaction gas is raised through the reaction gas exhaust portion. The reaction gas exhaust portion may be either an air outlet exhausting air and water or a hydrogen outlet exhausting hydrogen and water.

Advantageously, in the electric pump for a vehicle according to an exemplary embodiment of the present invention, since the leachate exhaust passage is connected to the reaction gas exhaust portion of the fuel cell stack through the connection pipe, the leachate that leaks from the pump room to the motor room is effectively exhausted. Also, since the leachate exhaust passage is connected to the reaction gas exhaust portion through the connection pipe in the present exemplary embodiment, the outside fluid is prevented from flowing into the motor room through the leachate exhaust passage.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF THE EMBODIMENTS

Figure 1:
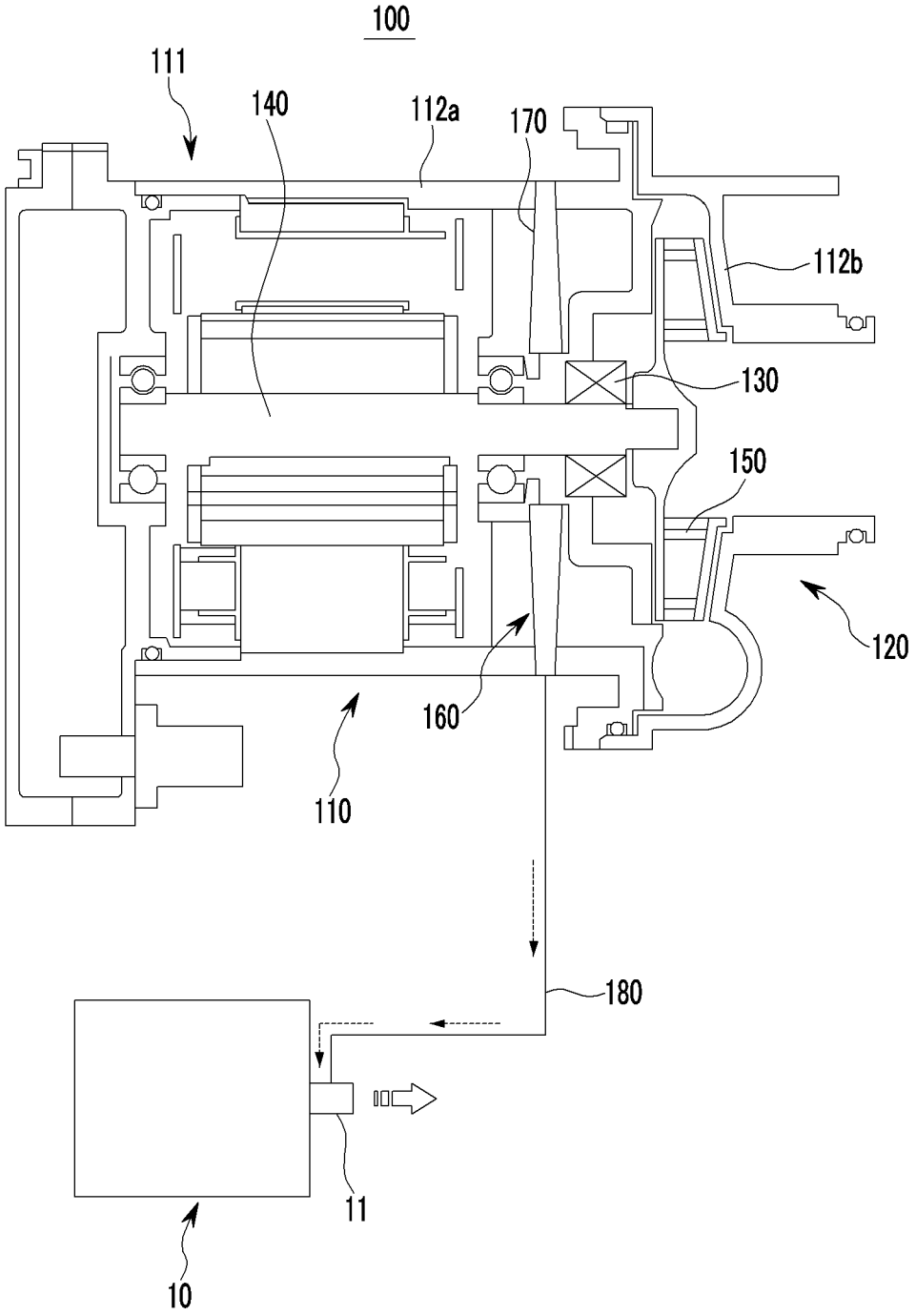
FIG. 1 schematically shows an electric pump for a vehicle according to an exemplary embodiment of this invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Portions having no relation with the description will be omitted in order to explicitly explain the present invention, and the same reference numerals will be used for the same or similar elements throughout the specification.

In the drawings, size and thickness of each element is approximately shown for better understanding and ease of description. Therefore, the present invention is not limited to the drawings, and the thicknesses of layers, films, panels, regions, etc., are exaggerated for clarity.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

FIG. 1 schematically shows an electric pump for a vehicle according to an exemplary embodiment of this invention. Referring to the drawings, an electric pump 100 for a vehicle according to an exemplary embodiment of the present invention is operated by electrical power and pumps coolant throughout a system to cool several portions of the vehicle thereof. The electric pump 100, for example, can be applied to a fuel cell vehicle, a hybrid vehicle or a general internal combustion engine of a vehicle. For instance, it can be used to cool a fuel cell stack 10 in the fuel cell vehicle.

The electric pump 100 is divided into a motor room 110 that is provided with a stator and a rotor, and a pump room 120 that pumps coolant. A pump body 111 divides the motor room 110 and a pump room 120. The pump body 111 includes a case 112*a* which forms the motor room 110 and a cover 112*b* that is engaged with the case to form the pump room 120. Here, the motor room 110 and the pump room 120 are separated by a sealing unit 130 (for example, a mechanical seal) that is used to prevent the coolant of the pump room 120 from flowing into the motor room 110. The sealing unit 130 is mounted on a shaft 140 that is connected from the motor room 110 to the pump room 120. And, an impeller 150 is mounted on the shaft of the pump room 120 so as to pump the coolant.

A leachate exhaust passage 160 is formed in the case 112*a* of the pump body 111 so as to exhaust the leachate to the outside, which leaks from the pump room 120 to the motor room 110 through the sealing unit 130, in the electric pump for a vehicle 100 as described above. Further, a steam exhaust passage 170 may additionally be formed in the case 112*a* of the pump body 111 so as to exhaust steam that is formed by the sealing unit 130 in the pump room 120.

In the illustrative embodiment of the present invention, the pump 100 can effectively exhaust the leachate and prevent the outside water from flowing into the pump body 111 through the leachate exhaust passage 160 To do so, the leachate exhaust passage 160 is connected to a reaction gas exhaust portion 11 of the fuel cell stack 10 in the illustrative embodiment of the present invention.

Here, the reaction gas exhaust portion 11 can be an outlet for exhausting reaction gas that reacts within a fuel cell. In this scenario, the outlet can be either an air outlet for exhausting air and water or a hydrogen outlet for exhausting hydrogen and water. In this case, the leachate exhaust passage 160 is connected with the reaction gas exhaust portion 11 of the fuel cell stack 10 through a connection pipe 180. More specifically, one end of the connection pipe 180 is connected to the leachate exhaust passage 160 and the other end thereof is connected to the reaction gas exhaust portion 11.

Figure 2:
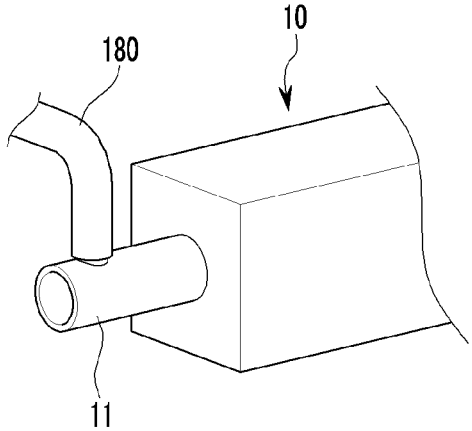
FIG. 2 shows a connection structure of a leachate exhaust passage and a fuel cell stack in an electric pump for a vehicle according to an exemplary embodiment of the present invention.

As shown in FIG. 2, the other end of the connection pipe 180 is not connected to an exhaust end of the reaction gas exhaust portion 11 but instead is connected to an exhaust line of the reaction gas exhaust portion 11 by for example an orifice pipe.

Accordingly, since the leachate exhaust passage 160 is connected to the reaction gas exhaust portion 11 of the fuel cell stack 10 through a connection pipe 180 in the electric pump 100 for a vehicle according to an exemplary embodiment of the present invention, the leachate can be exhausted through the reaction gas exhaust portion 11 of the fuel cell stack 10.

That is, the leachate that leaks from the pump room 120 to the motor room 110 through the sealing unit 130 is exhausted through the leachate exhaust passage 160, flows through the connection pipe 180 until it reaches the reaction gas exhaust portion 11 of the fuel cell stack 10, and can be exhausted to the outside together with exhaust reaction gas of the fuel cell through the reaction gas exhaust portion 11.

The leachate flows along the connection pipe 180 via a pressure difference between the leachate exhaust passage 160 and the reaction gas exhaust portion 11 is able to be exhausted through the reaction gas exhaust portion 11.

In the process, the steam that is generated by the sealing unit 130 is exhausted outside through the steam exhaust passage 170 of the pump body 111. In a case that the exhaust pressure of the reaction gas through the reaction gas exhaust portion 11 is increased, the outside air flows into the pump body 111 through the steam exhaust passage 170. With this, since the steam exhaust passage 170 of the pump body 111 is formed by an air inlet that intakes the air in the present exemplary embodiment, the leachate is effectively exhausted through the reaction gas exhaust portion 11.

Advantageously, the leachate that leaks from the pump room 120 to the motor room 110 is exhausted through the reaction gas exhaust portion 11 of the fuel cell stack 10 in the electric pump 100 in a vehicle according to an exemplary embodiment of the present invention. Also, since the leachate exhaust passage 160 is connected to the reaction gas exhaust portion 11 through the connection pipe 180 in the present exemplary embodiment, the outside fluid is prevented from flowing into the motor room 110 through the leachate exhaust passage 160.

That is, since the leachate that leaks from the pump room 110 to the motor room 110 through the sealing unit 130 is exhausted to the outside and the outside fluid is prevented from flowing into the motor room 110 in the present exemplary embodiment. Thus, the insulation performance of the motor is improved and bearings within the motor room are prevented from being corroded by the leachate.

It is not shown in the drawings according to the present exemplary embodiment, but it is natural that a separate isolation portion can be disposed to prevent the outside fluid from flowing into the steam exhaust passage 170 as well.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

10 . . . fuel cell stack
11 . . . reaction gas exhaust portion
110 . . . motor room
111 . . . pump body
120 . . . pump room
130 . . . sealing unit
140 . . . shaft
150 . . . impeller
160 . . . leachate exhaust passage
170 . . . steam exhaust passage
180 . . . connection pipe

What is claimed is:

1. An electric pump system for a vehicle, comprising:

an electric pump comprising a pump body divided into a motor room and a pump room, a shaft connected to the motor room and the pump room interposing a sealing unit, and an impeller mounted on the shaft in the pump room; and a fuel cell stack comprising a reaction gas exhaust portion that exhausts reaction gas, wherein a leachate exhaust passage for exhausting leachate that is leaked through the sealing unit is formed in the pump body, the leachate exhaust passage connected to the reaction gas exhaust portion of the fuel cell stack via a connection pipe, wherein an exhaust passage through which steam is exhausted is formed in the pump body, wherein the steam is formed via the sealing unit, and wherein the steam exhaust passage intakes outside air when an exhaust pressure of the reaction gas is raised within the reaction gas exhaust portion.

2. The electric pump system for a vehicle of claim 1, wherein the connection pipe includes an orifice pipe.

3. The electric pump system for a vehicle of claim 1, wherein the reaction gas exhaust portion is either an air outlet exhausting air and water or a hydrogen outlet exhausting hydrogen and water.

4. An electric pump system for a vehicle, comprising:

a pump body that is divided into a first compartment and a second compartment, wherein a sealing unit is interposed therebetween and a first passage for exhausting fluid that is leaked through the sealing unit is formed in the pump body;

a shaft that is connected to the first compartment and the second compartment; and an impeller that is mounted on the shaft in the second compartment, wherein the exhausting fluid is prevented from leaking into the first room due to an exhaust passage is connected to a reaction gas exhaust portion of a fuel cell stack via a connection pipe, wherein the exhaust passage exhausts steam and is formed in the pump body, wherein the steam is formed via the sealing unit, and wherein the steam exhaust passage intakes outside air when an exhaust pressure of the reaction gas is raised within the reaction gas exhaust portion.

5. An electric pump system for a vehicle, comprising:

an electric pump comprising a pump body, a shaft, and an impeller, the pump body being divided into a motor room and a pump room, the shaft being connected to the motor room and the pump room interposing a sealing unit, and the impeller being mounted on the shaft in the pump room; and a fuel cell stack comprising a reaction gas exhaust portion that exhausts reaction gas, wherein a leachate exhaust passage for exhausting leachate that is leaked through the sealing unit is formed in the pump body, and wherein the leachate exhaust passage connected to the reaction gas exhaust portion of the fuel cell stack via a connection pipe.

6. The electric pump system for a vehicle of claim 5, wherein the connection pipe includes an orifice pipe.

7. The electric pump system for a vehicle of claim 5, wherein an exhaust passage through which steam is exhausted is formed in the pump body, wherein the steam is formed via the sealing unit.

8. The electric pump system for a vehicle of claim 7, wherein a steam exhaust passage the intakes outside air in a case that an exhaust pressure of the reaction gas is raised within the reaction gas exhaust portion.

9. The electric pump system for a vehicle of claim 5, wherein the reaction gas exhaust portion is either an air outlet exhausting air and water or a hydrogen outlet exhausting hydrogen and water.

* * * * *